US008004136B2

(12) United States Patent
De Luca et al.

(10) Patent No.: US 8,004,136 B2
(45) Date of Patent: Aug. 23, 2011

(54) LAYING HEAD WITH A VIBRATION DAMPING DEVICE

(75) Inventors: Andrea De Luca, Remanzacco (IT); Alfredo Poloni, Fogliano Redipuglia (IT); Ivan Paiaro, Ronchi Dei Legionari (IT); Miroslav Zerajic, Palmanova (IT)

(73) Assignee: Danieli & C. Officine Meccaniche, S.p.A., Buttrio (IT)

( * ) Notice: Subject to any disclaimer, the term of this patent is extended or adjusted under 35 U.S.C. 154(b) by 960 days.

(21) Appl. No.: 10/589,826

(22) PCT Filed: Feb. 23, 2005

(86) PCT No.: PCT/IB2005/000458

§ 371 (c)(1),
(2), (4) Date: Aug. 17, 2006

(87) PCT Pub. No.: WO2005/084842

PCT Pub. Date: Sep. 15, 2005

(65) Prior Publication Data

US 2009/0108692 A1 Apr. 30, 2009

(51) Int. Cl.
*H02K 7/09* (2006.01)

(52) U.S. Cl. ..... 310/90.5; 384/99; 384/100

(58) Field of Classification Search ..... 310/90.5; 384/99, 100

See application file for complete search history.

(56) References Cited

U.S. PATENT DOCUMENTS

| | | | | |
|---|---|---|---|---|
| 3,680,932 | A | 8/1972 | Raimondi | |
| 4,339,780 | A * | 7/1982 | Okubo | 361/147 |
| 4,643,592 | A | 2/1987 | Lewis et al. | |
| 4,700,909 | A * | 10/1987 | Lohrenz et al. | 242/331.1 |
| 4,999,534 | A * | 3/1991 | Andrianos | 310/90.5 |
| 5,142,177 | A | 8/1992 | Higuchi et al. | |
| 5,714,818 | A * | 2/1998 | Eakman et al. | 310/90.5 |
| 6,135,639 | A | 10/2000 | Dede | |
| 6,543,712 | B2 | 4/2003 | Grimmel et al. | |
| 2002/0074883 | A1 * | 6/2002 | Yamauchi et al. | 310/90.5 |
| 2002/0190592 | A1 * | 12/2002 | Kawasaki | 310/90.5 |
| 2003/0113049 | A1 | 6/2003 | Shore et al. | |

FOREIGN PATENT DOCUMENTS

EP 0 684 093 A1 11/1995

* cited by examiner

*Primary Examiner* — Quyen Leung
*Assistant Examiner* — Alex W Mok
(74) *Attorney, Agent, or Firm* — Stetina Brunda Garred & Brucker

(57) ABSTRACT

A laying head for forming coils using continuous and substantially rectilinear rolled products such as rods or wire, having vibration damping means integrated in one of two rotor supports (3), preferably the one on the rolled product outlet side. Said means comprise a plurality of coils (6, 6', 6") arranged around the rotor (3), rotating about its axis (X), which generate a magnetic field actively controlled by a computer, the resultant force of which is perpendicular to the axis (X) and of a predetermined intensity so as to eliminate the inertial forces generated by the mass imbalances. Alternatively, the damping means incorporated in one of the supports are comprised of oil film bearings.

10 Claims, 4 Drawing Sheets

LAYING HEAD WITH A VIBRATION DAMPING DEVICE

FIELD OF THE INVENTION

The present invention relates to a laying head having a vibration damping device for winding of substantially rectilinear rolled steel products, such as wire, rods or the like.

PRIOR ART

A relatively common solution utilized in realizing laying heads consists in providing a rotor in which the laying pipe is housed. The rotor is supported as cantilever on a stator body by means of two roller bearings, or supports, and in turn the stator body is rigidly constrained to a base integral with the ground. The rotor rotates about its own axis, generally at high angular velocities, which reach 2200 rpm, corresponding to a rolling speed of 120 m/sec. Rotation is produced by an external motor connected by means of a bevel gear drive system. Some types of laying heads have rotors that integrate the motor within and mount the motor stator coaxially.

In a laying head, as a result of the pipe wear during operation, it inevitably occurs that the rotating components are no longer dynamically balanced, thus causing vibrations that increase in intensity as the rotation speed increases.

In particular, these vibrations are amplified by dynamic effects when the rotation speeds are in the vicinity of characteristic system speeds, namely critical speeds.

These dynamic amplifications produce high vibrations which are detrimental to structural integrity, and in fact limit the maximum operating speeds which can be reached.

In laying heads of the conventional type currently in use, dynamic amplification phenomena occur starting from 2000-2200 rpm, which consequently are the maximum operating speeds that these machines can currently reach.

Therefore, through time means have been sought to increase the critical speeds of the laying heads in order to increase maximum operating speeds.

The document U.S. Pat. No. 6,543,712 has the object of attaining a rolling speed higher than 120 m/sec. To do this a third support is used, arranged in the intermediate position between the two bearings and this reduces deformation of the rotor shaft with the result that the critical speeds increase in value.

This type of support is composed of rollers radially arranged with respect to the shaft but this device is very complicated in mechanical terms and has low efficiency, since also the rollers are provided with their own flexibility. Having small diameters, the rollers are subjected to extremely high rotational speeds. Another drawback of this solution consists in the fact that even minimum differences in coaxiality between the end bearings and the additional support cause unacceptable vibrations in the system.

The document EP 684093 proposes the use of magnetic bearings for sustaining the head with the advantage of attaining high rotational speeds of the rotor, around 3000 rpm corresponding to over 160 m/sec for the rolling speed, without causing vibrations. A drawback of this type of device is its high cost.

A third document, US2003/0113049 instead describes a unit to support rotation of a spindle in the housing of a laying head. This unit comprises a first and a second mechanical roller bearing, distanced axially and interposed between the spindle and the housing. A radial preload force is applied to the first bearing in a first area along the circumference thereof. This preload force is opposed by a reaction force acting on the second bearing in a second area along the circumference thereof, at an angular distance of 180° from the first area. In this way some clearances and the relative vibrations are partly reduced, but the solution is not very practical and optimal results cannot be obtained.

A fourth document EP0679453 proposes reducing the overhang of the pipe carrying rotor, in order to increase the critical speeds. To do this, the diameter of the mechanical roller bearing on the rolled product outlet side, normally around 400 mm, is increased in view of the new pipe dimension to a value of 500 mm. It is known that mechanical rolling bearings with such large dimensions become particularly critical at high rotation speeds, and therefore this solution is not very practical and, moreover, frequent breakage of these mechanical bearings occurs.

SUMMARY OF THE INVENTION

Therefore, the main object of the present invention is to produce a laying head that can operate at a rolling speed of over 120 m/sec up to at least 140 m/sec without being affected by harmful vibrations caused by dynamic amplification phenomena.

The invention must also allow this scope to be achieved at acceptable engineering costs, without mechanically complicating the devices and without giving rise to severe wear conditions of the mechanical elements.

These objects are achieved by providing the laying heads with a vibration damping device, integral with, or replacing, one of the supports.

Conventionally defined on the laying head is an inlet side, facing the rolled product feed channel, and a outlet side, facing the rolled product outlet.

According to a first advantageous embodiment, the laying head according to the invention is provided with a magnetic device that damps the vibrations actively.

Said device is advantageously placed in proximity of the mechanical bearing placed on the wire outlet side. The magnetic damping device acts principally, but not exclusively, in the orizontal plane where rigidity of the mechanical bearings is minimum due to the geometric clearance normally provided.

According to another aspect of the invention the aforesaid objects are achieved by means of a first vibrations damping method, implemented on the laying head by means of the aforesaid magnetic device comprising the following steps:

a) detecting by means of sensors of dynamic parameters relative to the vibrations produced by the rotor during a rotation thereof on the support structure;

b) transmitting predetermined data, relative to dynamic parameters, to electronic control means;

c) defining activation modes of magnetic coils so that magnetic forces are produced, the resultant of which is such as to eliminate inertial forces producing vibrations in the rotor.

In virtue of the application of the magnetic damping device, the laying head has a plurality of advantages:

- active damping of the vibrations makes it possible to reach rolling speeds of up to at least 140 m/sec, with vibrations that remain at an acceptable level;
- the magnetic field control system is much simpler than that of the magnetic bearings, which have an exclusive function of supporting the rotor, since it is unnecessary to provide the sustaining functionality as well;
- again compared to magnetic bearings, sizing of the coils is also more advantageous, since the forces in play are smaller due to the fact that it is unnecessary to generate a supporting magnetic field that completely raises the entire rotor;

in the event of breakage of the active control system, the laying head however be advantageously operated up to the limits of mechanical vibration, until the active control system is restored;

there being a limited number of structural elements that come into play, the reliability of the system is enhanced.

In a second embodiment of the invention, the laying head is provided with a passive type vibration damping device, more specifically of the hydraulic type, which advantageously replaces or integrates the conventional mechanical rolling bearing placed on the wire outlet side. The operating principle of said device is based on the properties of sustaining and absorbing the dynamic loads of a thin layer of viscous fluid, hereinafter called meatus. The device has the dual function of providing hydrodynamic support for the rotor shaft and of hydraulically damping oscillations, also limiting dynamic amplifications in the vicinity of critical rotation speeds.

Said device advantageously utilizes the same oil that lubricates the mechanical bearing, which co-operates with the rolled product inlet side, and the bevel coupling by means of which, by way of the motor, the laying head is operated.

The hydraulic device can comprise a lobed bearing or bushing or advantageously a radial tilting pad bearing, which makes it possible to obtain a greater stability of the oil film. Advantageously, these bearings of the hydraulic device have a service life up to 100 times higher compared to the life of a conventional rolling bearing and, in virtue of their capacity to withstand high dynamic loads and to absorb dynamic oscillations, make it possible to substantially reduce the vibrations in a laying head even for significant imbalance values of the rotor.

According to a third embodiment, the laying head can advantageously be provided with both the active magnetic damping device and the passive hydraulic damping device.

According to another embodiment, the hydraulic device can replace both the conventional rolling bearings, either in combination with, or without, a magnetic damping device.

In accordance with a further embodiment, at least one axial type hydrodynamic bearing is installed in proximity of the rolled product inlet side.

BRIEF DESCRIPTION OF THE FIGURES

Further advantages which can be achieved with the present invention will become more apparent to those skilled in the art from the following detailed description of a non-limiting exemplary embodiment of a laying head with reference to the following figures, wherein.

DETAILED DESCRIPTION OF THE INVENTION

Figure 1:
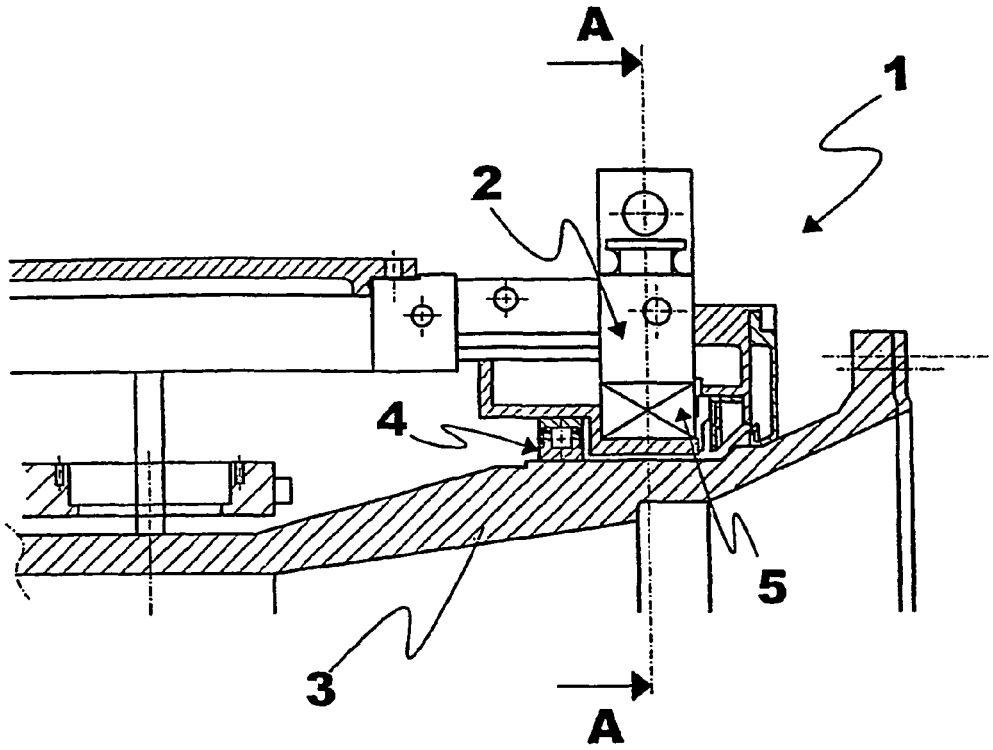
FIG. 1 represents a longitudinal section in the axial plane of a laying head according to the invention.
Figure 2:
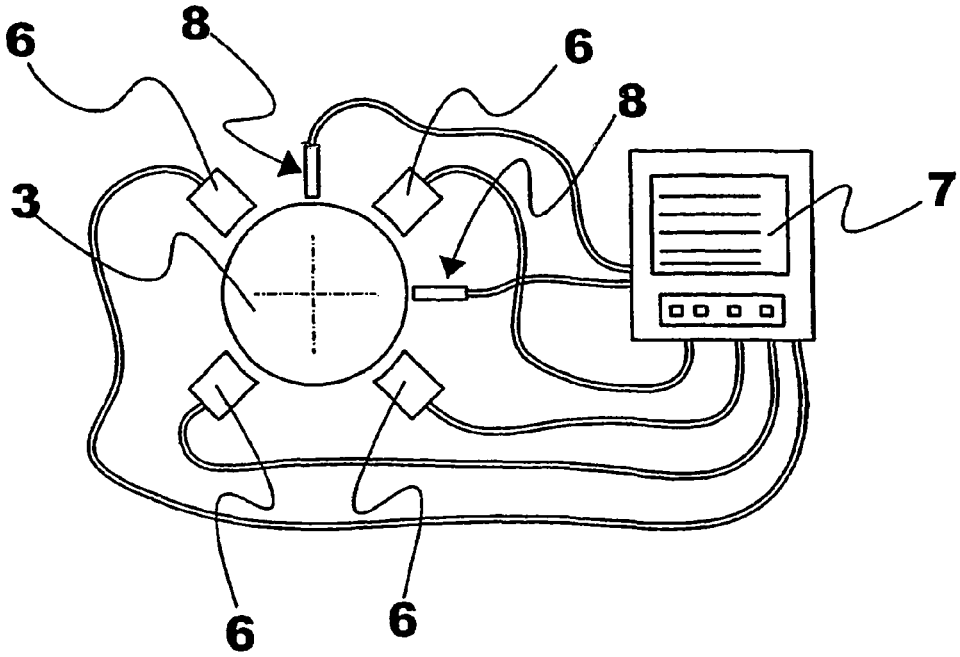
FIG. 2 represents a section in the axial plane A of the head of FIG. 1.

With particular reference to the cited figures, a laying head, indicated as a whole with the reference numeral 1, comprises a support structure 2, also called stator body, in which a rotor 3 is adapted to rotate about an own axis (X) and is held in rotation by means of two mechanical bearings 4, for example roller bearings. The rotor 3 substantially comprises a spindle housing the laying pipe, through which the rolled material to be coiled passes. On the rolled product inlet side in the rotor, the bearing has a smaller diameter and on the outlet side of the rotor the supporting mechanical bearing 4 has a larger diameter. One of the bearings, for example the one with the smaller diameter, not shown in the figure, performs a constraining function in the axial direction.

The rotor 3 is fixed integral to a conical wheel that receives motion by means of a gear train of a motor, not shown, of known type. Another device of known type can also be used as the driving mechanism.

According to a first embodiment, which provides for the use of an active magnetic damping device, a magnetic device 5 is placed in proximity of the bearing having a greater diameter is, this device 5 comprising one or more magnetic coils 6 arranged around the circumference of the rotor 3. These coils are operated by means of a control system 7, advantageously of the electronic type, which modulates the magnetic force acting on the rotor 3 so as to damp the intensity of the vibrations that are produced as the rotor 3 increases the rotational speed, creating a resultant force modulated in direction and intensity.

In order to transmit information on the dynamic situation of the rotor at any given time during operation of the laying head, position sensors 8 are provided to transmit the data to the operating system, which operates the coils according to a predefined scheme.

The magnetic device can be installed either in series or in parallel with the mechanical bearing. In the first configuration in series, the mechanical bearing is installed on an elastic flange, in turn coaxial to the magnetic bearing. The elasticity of the flange is necessary to limit the constraining forces acting on the support structure and to ensure centring of the shaft. In this case, the magnetic device 5 acts only as a damper but not as a bearing. This second function is performed only by the mechanical bearing 4.

Figure 3:
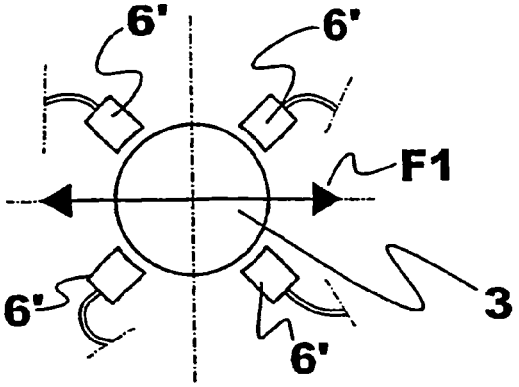
FIG. 3 represents a schematic view of a detail of the laying head of the invention in one embodiment.
Figure 4:
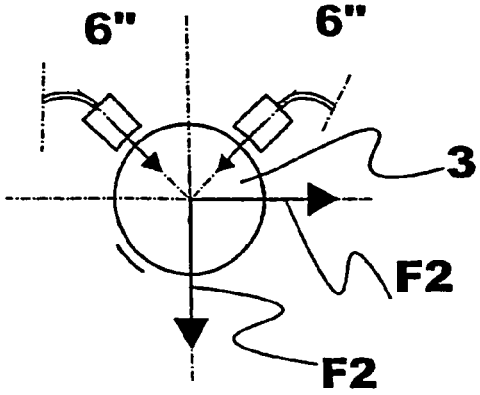
FIG. 4 represents a schematic view of a detail of the laying head of the invention in an alternative embodiment.

In this configuration in series two embodiments according to the invention are provided. The first embodiment provides that the damper acts solely in the horizontal plane. FIG. 3 schematically represents this embodiment in which one or more coils 6' are provided both in the upper quadrant and in the lower quadrant and the resultant F1 of the forces generated by the magnetic coils 6' is horizontal. The second embodiment of the configuration in series of the magnetic device is the one schematically illustrated in FIG. 4, wherein the magnetic coils are arranged only in the upper quadrant, or along a semicircle of the rotor 3, and the resultant magnetic force F2 acts both in the horizontal and in the vertical plane, in a straight downward direction.

Figure 5:
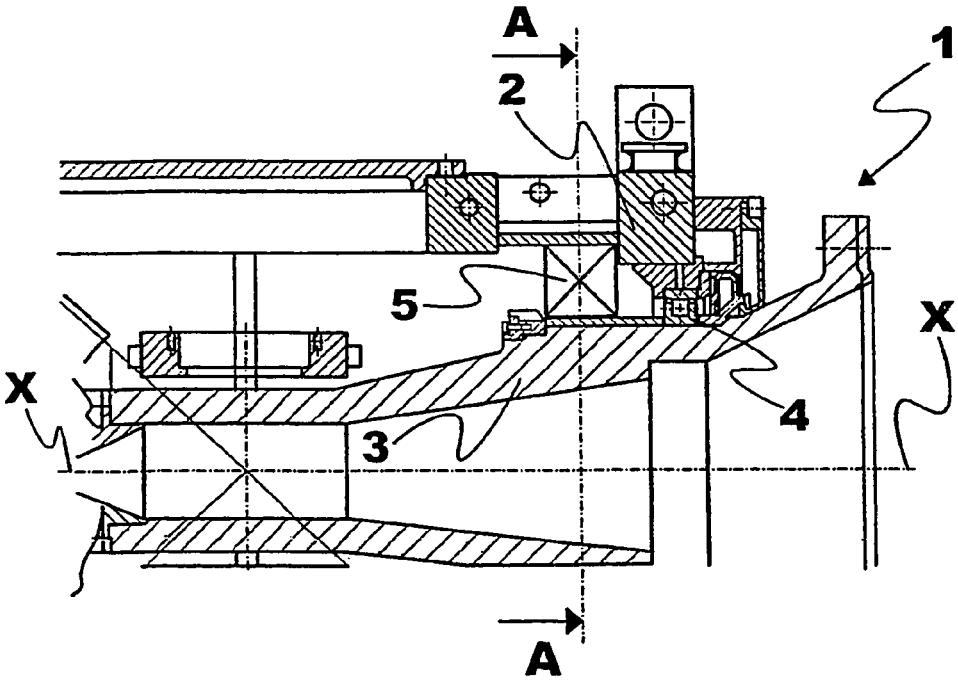
FIG. 5 represents a longitudinal section in the axial plane of a laying head in an alternative embodiment according to the invention.

In the case in which the magnetic device 5 is arranged in parallel, the mechanical bearing 4 is installed directly on the body of the machine 2 and the magnetic device 5 acts in parallel directly on the rotor 3. In this case the supporting function is left to the mechanical bearing, while the magnetic device 5 acts solely as a damper. This embodiment is represented in FIG. 5.

Figure 6:
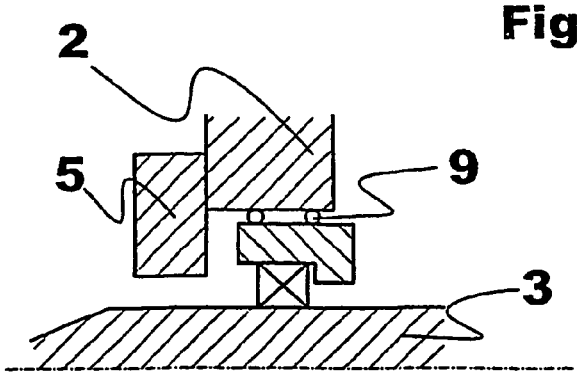
FIG. 6 represents a section in the axial plane of a detail of the laying head of the invention in a further embodiment.
Figure 7:
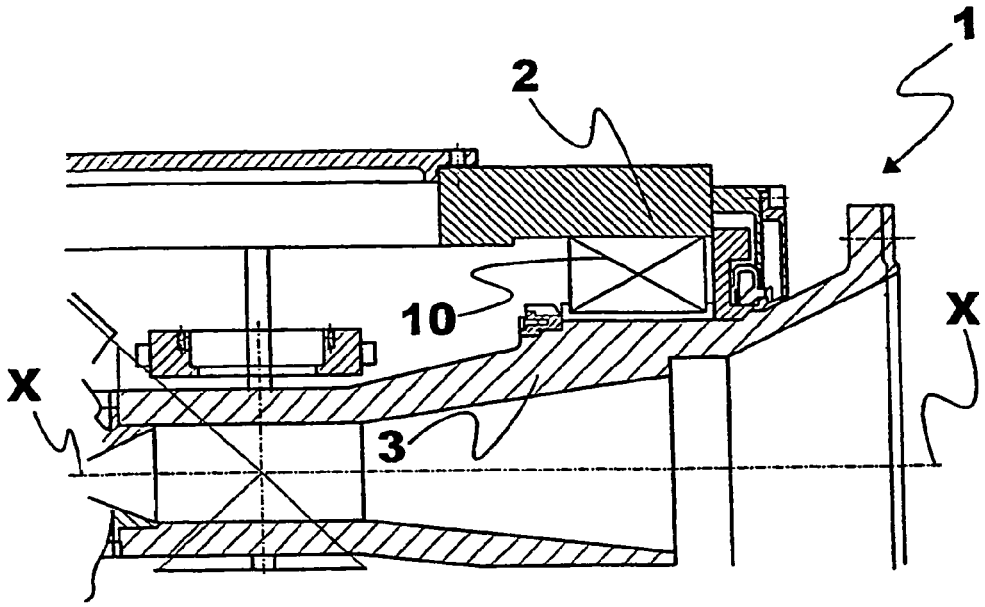
FIG. 7 represents a section in the axial plane of an alternative embodiment of a laying head according to the invention.
Figure 8:
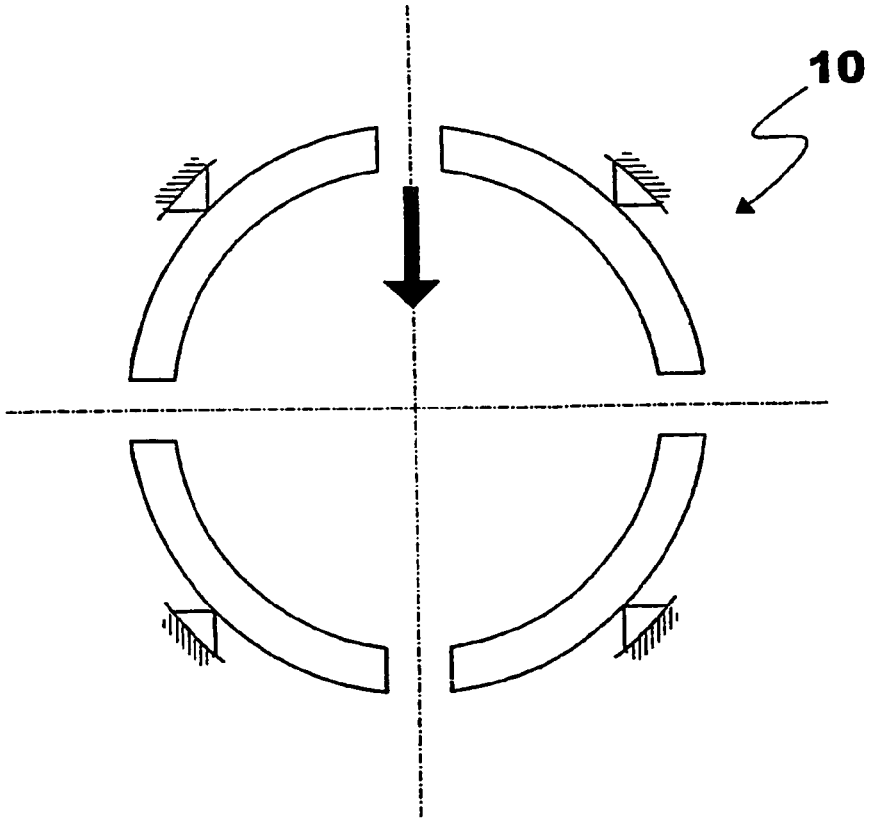
FIG. 8 schematically represents a section in a plane orthogonal to the axis of the head of FIG. 7.

In an advantageous embodiment according to the invention, the housing in which the mechanical bearing is installed is flexible, with a suitably determined rigidity to reduce the forces that are discharged onto the support structure. This flexibility is realized by means of elastic inserts 9 between the mechanical bearing 4 and the support structure 2. This embodiment is represented in FIG. 6. This advantageous embodiment can be used both in the arrangement in parallel and in the one in series of the magnetic damping device.

According to the invention, the magnetic damping device can advantageously be arranged either inside, or alternatively outside the bearing with the larger diameter. According to another embodiment, the use of a passive hydraulic damping device is proposed, said device being integrated into or replacing a support of the laying head, for example the conventional mechanical rolling bearing on the rolled product outlet side.

In a first embodiment, said device is essentially comprised of a hydrodynamic oil film bearing.

Figure 9:
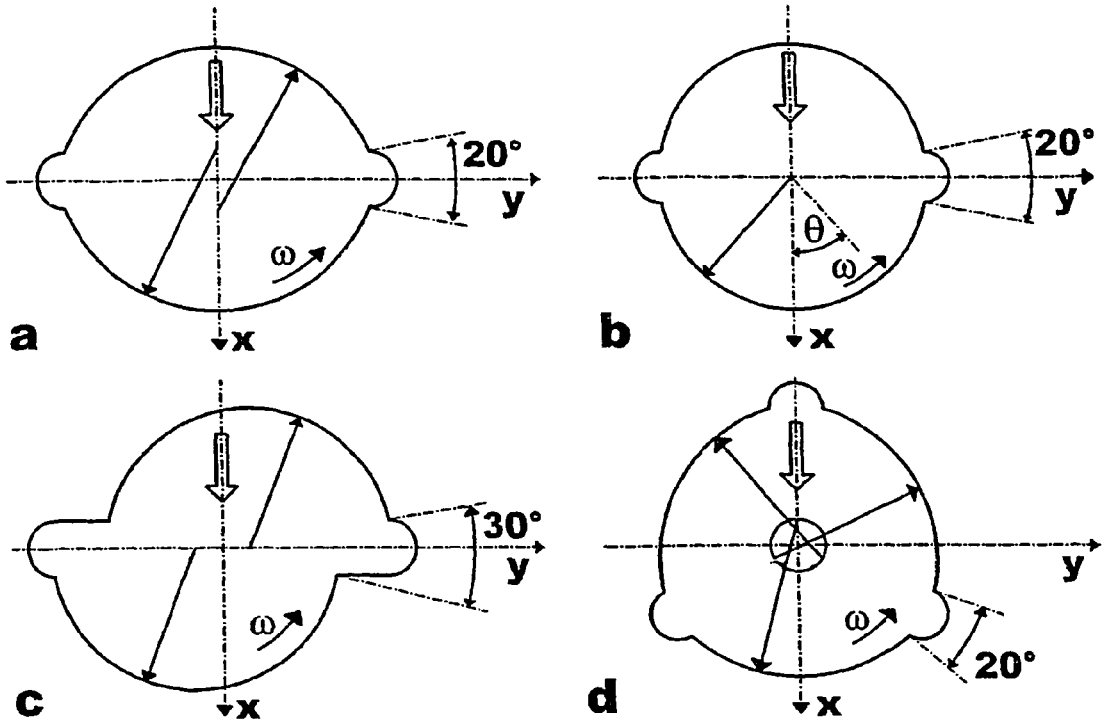
FIGS. 9*a* to 9*d* represent schematic sections of bearings used in the laying head of the invention.

FIGS. 9*a* to 9*d* illustrate the sections of several alternative layouts of hydrodynamic bearings which can be used to achieve the scope of the invention. In more detail, FIGS. 9*b* and 9*c* respectively illustrate a symmetrical and asymmetrical two-lobed bearing. A two-lobed bearing has the feature of having high anisotropic strengths in terms of rigidity and damping effect; furthermore, an asymmetrical two-lobed bearing has the feature of being more stable compared with a symmetrical one. The offset configuration in FIG. 9*c* is particularly advantageous in terms of simplicity, overall dimensions, costs and rigidity/damping features.

FIGS. 9*a* and 9*d* illustrate an elliptical two-lobed bearing and a three-lobed bearing, respectively. A bearing with three or four lobes is isotropic with regard to the dynamic rigidity and damping coefficients and makes it possible to maintain a substantially circular orbit of the shaft.

In order to prevent the occurrence of instability phenomena of the oil film, known as asynchronous "oil whirl" and "oil whip" produced by the vortex motion of the circumferential flow, according to an advantageous embodiment the passive hydraulic damping device is provided with a tilting pad bearing. Said pads, not necessarily identical, are free to move around pivots fixed to a containment ring. In dynamic operation, each pad follows the shaft perfectly in its movement and the bearing is thus highly stable. In practice, the circumferential flow is upset and slowed down by the non-circular geometry of the tilting pad bearing and the problem of instability is in practice completely solved for all operating conditions of load and rotational speed of the laying head.

Figure 10:
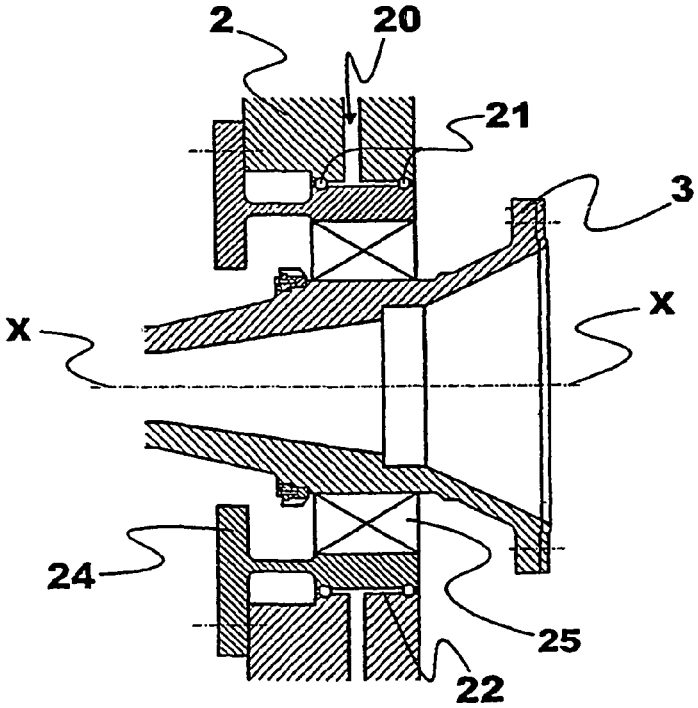
FIG. 10 represents a section in the axial plane of a further alternative embodiment of a laying head according to the invention.

Another advantageous alternative embodiment of the hydraulic damping device is illustrated FIG. 10 which refers to a so called "squeeze film" device. This essentially comprises a sleeve 24 interposed between the mechanical bearing 25 and the support structure 2 of the rotor 3; between the sleeve 24 and the support structure 2 an annular cavity 22 is produced, into which the lubricating oil flows through the duct 20, said oil being contained by end gaskets 21. The oil film that forms in said annular cavity performs the function of vibration damping.

A particularly advantageous embodiment of the device of the invention provides that all the supports of the laying head are equipped with hydrodynamic or oil film bearings, namely the front radial bearing, the front axial bearing and the rear radial bearing.

Experimental tests conducted on the laying head of the invention have confirmed that the use of a hydrodynamic oil film bearing increases the rigidity of the system in the horizontal plane, simultaneously providing a significant damping value, so as to operate in the range from 0 to 140 m/sec to contain vibrations below the acceptable limits even when there are significant imbalances.

In particular, with balanced rotors (degree of balance G6.3, according to the standard ISO 1940), vibrations are maintained below the threshold of 1 mm/sec of effective value, or RMS value (root-mean-square), while with significant imbalances (G28) the vibrations did not in any case exceed 4 mm/sec RMS against a maximum acceptable threshold of 7 mm/sec RMS.

In general, application of one of the other embodiment of the passive hydraulic damping device makes it possible not only to obtain optimum results from the point of view of vibrations damping but also allows all the typical limits of a rolling bearing to be overcome, namely increased sensitivity to impact, increased noise, high cost, need for maintenance, low coefficient of dynamic load and, consequently, limited service life.

From the description it is apparent that all the advantages sought in the introduction are achieved by means of the laying head of the invention; in particular, a laying head is obtained which can operate at rotational speeds exceeding the current maximum limits at reduced costs.

The invention claimed is:

1. A laying head for forming coils of continuous and substantially rectilinear rolled products comprising a support structure (2), a rotor (3) adapted to rotate about its own axis (X) under the action of motor means and held in rotation by the support structure (2) by means of bearings (4), characterized in that there are only two bearings and that at least one of the two bearings (4) incorporates vibrations damping means comprising a passive oil film bearing (10) of the hydrodynamic type.

2. Laying head according to claim 1, wherein each of the bearings (4) incorporates said vibrations damping means.

3. Laying head according to claim 1, wherein, in proximity of a rolled product inlet side, at least one axial type hydrodynamic bearing is provided.

4. Laying head according to claim 1 or 2, wherein said hydrodynamic bearing (10) is of the "tilting pad" type.

5. Laying head according to claim 1 or 2, wherein said hydrodynamic bearing (10) is of the lobed type.

6. Laying head according to claim 5, wherein in said hydrodynamic bearing (10) there are provided three lobes.

7. Laying head according to claim 5, wherein in said hydrodynamic bearing (10) there are provided two lobes.

8. Laying head according to claim 7, wherein the arrangement of the lobes on the bearing is asymmetrical.

9. Laying head according to claim 1, wherein the oil film bearing (24) is of the "squeeze film" type.

10. Laying head according to claim 1 wherein one bearing is located on each side of the rotor.

* * * * *